US009526943B2

(12) United States Patent
Emick

(10) Patent No.: US 9,526,943 B2
(45) Date of Patent: Dec. 27, 2016

(54) TRICEPS CABLE EXTENSION DEVICE

(71) Applicant: Daniel W. Emick, Montoursville, PA (US)

(72) Inventor: Daniel W. Emick, Montoursville, PA (US)

( * ) Notice: Subject to any disclaimer, the term of this patent is extended or adjusted under 35 U.S.C. 154(b) by 0 days.

(21) Appl. No.: 14/545,613

(22) Filed: May 29, 2015

(65) Prior Publication Data

US 2016/0346589 A1 Dec. 1, 2016

(51) Int. Cl.
*A63B 71/00* (2006.01)
*A63B 21/078* (2006.01)
*A63B 21/00* (2006.01)

(52) U.S. Cl.
CPC ..... *A63B 21/1476* (2013.01); *A63B 21/1469* (2013.01); *A63B 21/1484* (2013.01); *A63B 21/152* (2013.01)

(58) Field of Classification Search
CPC ..... A63B 21/1469; A63B 21/1476; A63B 21/1484; A63B 21/40; A63B 21/4027; A63B 21/4033; A63B 21/4035; A63B 21/15; A63B 21/151; A63B 21/152; A63B 23/035; A63B 23/03516; A63B 23/03525
USPC ..... 482/92–104, 139
See application file for complete search history.

(56) References Cited

U.S. PATENT DOCUMENTS 3,879,048 A * 4/1975 Penney ..... A63C 11/222 280/821
3,966,202 A * 6/1976 Cynamon ..... A63B 69/12 434/254
4,109,908 A * 8/1978 Pugh ..... A63B 21/065 482/105
4,641,857 A * 2/1987 Gailiunas ..... A63C 11/222 16/DIG. 12
5,058,923 A * 10/1991 Dale ..... A63C 11/22 135/65
5,076,569 A * 12/1991 Gootter ..... A63B 23/03508 482/49
5,399,133 A * 3/1995 Haber ..... A63B 21/4001 482/115

(Continued)

OTHER PUBLICATIONS

Website www.ironcompany.com.
Website http://totalgymcare.com.au.sales.
Website http://www.gtechfitness.com.

*Primary Examiner* — Stephen Crow
*Assistant Examiner* — Garrett Atkinson
(74) *Attorney, Agent, or Firm* — Thomas R. Shaffer

(57) ABSTRACT

A triceps cable extension for attachment to a cable resistance exercise machine is provided. The cable extension includes a gripping handle including a hand protection projection which extends at an angle B upwardly from a thumb groove provided in the handle. An open semi-circular cross-sectional channel is provided in the protection projection to receive a cover cable. A vertical bore extends from a handle base flange portion through a body portion and extending into the protection channel. The extension also includes a length of cable, a cable securing nut, a connection loop so as to allow a snap on connection to a cable resistance exercise machine and also includes a latex tubing cable cover to protect the user from injury from an exposed wire cable. The protection projection and the projection channel to protect the user's hand and reduces torque on the handle in use.

5 Claims, 10 Drawing Sheets

(56) References Cited

U.S. PATENT DOCUMENTS

| | | | | |
|---|---|---|---|---|
| 5,709,637 | A * | 1/1998 | Gow | A63B 23/12 482/121 |
| 5,979,015 | A * | 11/1999 | Tamaribuchi | A63C 11/22 16/110.1 |
| 6,569,066 | B1 * | 5/2003 | Patterson | A63B 21/0552 482/106 |
| 6,652,420 | B2 * | 11/2003 | Chen | A63B 23/12 482/139 |
| D498,130 | S * | 11/2004 | Tomchak | D8/107 |
| 6,835,169 | B2 * | 12/2004 | Tamaribuchi | A63B 5/20 482/139 |
| 7,819,789 | B2 * | 10/2010 | Berman | A63B 21/0004 482/121 |
| 8,092,411 | B2 * | 1/2012 | Betcher | A61F 5/0118 128/878 |
| 8,172,727 | B2 * | 5/2012 | Berman | A63B 21/0004 482/44 |
| 8,491,448 | B2 * | 7/2013 | Emick | A63B 23/03508 482/102 |
| 9,278,247 | B2 * | 3/2016 | Kristiansen | A63B 71/00 |
| 2010/0037433 | A1 * | 2/2010 | Walker | A63B 21/4017 16/421 |

* cited by examiner

TRICEPS CABLE EXTENSION DEVICE

This application claims priority from the disclosure made in Provisional Patent Application No. 61/997,807 filed Jun. 11, 2014.

BACKGROUND OF THE INVENTION

1. Field of the Invention The present invention relates to a triceps cable extension device. More specifically it relates to a unique grip handle which effectively and comfortably replaces and improves the griping interface between a user and a resistance exercise machine.

2. Description of the Prior Art

Various gripping devices for performance of triceps extension arm strengthening exercises are known in the art. These devices include various rope (FIGS. 1 and 2), nylon strap (FIG. 3), and steel configurations (FIGS. 4-6) and are utilized by first attaching the devices by means of cable snap hooks to cable resistance exercise machines. Users next grip the attached devices and with arm(s) fully bent at elbow, straighten arm(s) against machines resistance to solicit strengthening benefits for the rear upper arm triceps muscles.

The most prevalent gripping implement for triceps extension exercises are triceps ropes. In both single and double hand renditions, triceps ropes are nothing more than a short rope with knots tied in the ends. The ropes are then attached to cable resistance machines with snap hook provided on center of rope. More recent triceps ropes, reflect modest improvements by providing rubber hand rests in place of knots (see FIGS. 1 and 2) and by providing steel snap hook attachment rings at center, or ends of single style ropes.

The primary benefits of triceps ropes are simplicity of use. Users simply grab rope with hand heel(s) on the rubber stop or knots, with arm(s) bent at the elbow. Then the user extends his/her lower arm against a pre-set cable machine resistance. Additionally, triceps ropes are well established as reasonably effective triceps conditioning tools.

A drawback associated with triceps ropes in regards to aesthetics is that they have a dated appearance which has remained virtually unchanged for decades. In terms of function, triceps ropes can become slippery with sweat and it can be difficult to maintain a grip during use. Furthermore, triceps ropes fail to capitalize on the potential of the extension exercise due to the inflexibility of a 1.5" thick rope construction which hinders skeletal joint mobility and optimal stabilizer muscles training benefits from being fully realized. As for comfort or lack thereof, the somewhat abrasive ropes can be uncomfortable to grip against resistance. Lastly, triceps ropes appearance can be intimidating to neophytes. And sweat soaked, multiuser triceps ropes are virtually impossible to disinfect making them a potential risk to all users in this age of drug resistant bacteria and viruses.

As an alternative to ropes, existing triceps extension grip devices are nylon stirrups and chrome steel handles. Regarding the nylon stirrups (see FIG. 3), the primary benefits are an unintimidating design, hand loops that negate the need to tightly grip (as with triceps ropes), and increased joint mobility made possible because of the thinner nylon webbing construction. A drawback of the triceps straps is that they provide severely lessened wrist conditioning benefits as there is little need to grip the device during exercise. Additionally, the same multiuser contamination issues common to triceps ropes apply to the straps as well.

Chrome steel handles in their various configurations (see FIGS. 3-5), though simple to attach and use, are often cold to the touch, and slippery to grip during exercise induced sweating. Further, these handles are heavy, clunky and provide limited skeletal joint mobility due to direct attachment to cable machine snap hooks.

SUMMARY OF THE INVENTION

In its simplest form, the present invention provides a triceps cable extension device for attachment to a cable resistance exercise machine and comprises: a) a gripping handle, said handle being a generally cylindrical member having a handle base flange portion to allow the handle to stand upright on a horizontal surface, a handle body portion, said handle body portion having four recesses along a first side configured to receive the fingers of a user, having a heel portion on a second side which is configured to be received by the palm of the hand a user, a thumb groove on said second side configured to receive the thumb of a user, and a handle top portion including a hand protection projection which extends at an angle upwardly from said thumb groove, said hand protection projection having an open semi-circular cross-section channel therein sized to receive a covered cable, said handle having a vertical bore therein extending from the handle base flange portion, through the body portion and extending into said projection groove; b) a length of cable extending through said gripping handle bore with a portion thereof extending upward away from said handle top portion; c) a cable securing means, positioned in a cylindrical recess provided in an underside of said base flange portion, said securing means attached to a first end of said cable for preventing said first end of said cable from being pulled upwardly through said handle; d) a connection, loop attached to a second end of said cable so as to allow a snap on connection to a cable resistance exercise machine; and e) a tubing cable cover, covering exposed portions of said cable between the top of the gripping handle and said connection loop.

Preferably, said bore extending from said handle top portion causes weight to be directed primarily to a user's fingers when pulling downward from above a user's waist and said angled projection and channel therein reduces the torque and pressure which would otherwise be directed to skin between a user's thumb and index finger when pushing downward from below a user's waist because said cable is received in said channel.

Preferably, said gripping handle formed from rubber or plastic

Preferably, said cable cover is formed of latex

Preferably, said angle of said protection projection is between 20 degrees and 50 degrees as measured from a horizontal plane when said gripping handles are standing vertically on a horizontal surface.

Preferably, said angle of said protection projection is approximately 30 degrees as measured from a horizontal plane when said gripping handles are standing vertically on a horizontal surface.

Preferably, said handle base portion is generally ovoid in shape.

Optionally, a pair of triceps cable extension devices are attached to a singular connection loop allowing a user to exercise both arms at the same time.

The present invention, provides multiple advantages above and beyond existing triceps ropes, straps and steel handles. For starters, the present invention's custom pistol grip invites exercisers to grasp its soft, ergonomically correct hand shaped form which is superior to existing devices. Further, because the present invention is preferably accented with brightly colored cable covers, the present invention is aesthetically pleasing. As an added benefit the present invention attaches to resistance machines in the same way as other triceps exercise implements, and thus, users need not question how to set up or utilize this new triceps extensions training device.

Regarding function, the present invention, fitted hand grip and heel pad provide a comfortable slip free hold during sweaty bouts of exercise. From a training effectiveness perspective, the present invention's ultra thin, flexible cable suspension delivers optimal exercise freedom of movement. It further offers optimal triceps, forearm, wrist and hand "stabilizer muscle" conditioning effects which are far superior to that which can be obtained using existing devices. Still further, unlike existing ropes and straps, the present invention can quickly and easily disinfected by wiping with any common antibacterial wipe.

The present invention can be provided in both single and double handle configurations in the same manner as conventional triceps ropes for maximum user appeal.

As will be explained in greater detail, additional benefits of the present invention are created by the provision of the hand protection projection in the gripping handle and the groove therein. This groove reduces torquing pressure on the hand when the hand is pushed below the user's waist.

DETAILED DESCRIPTION OF THE PREFERRED EMBODIMENTS

Figure 1:
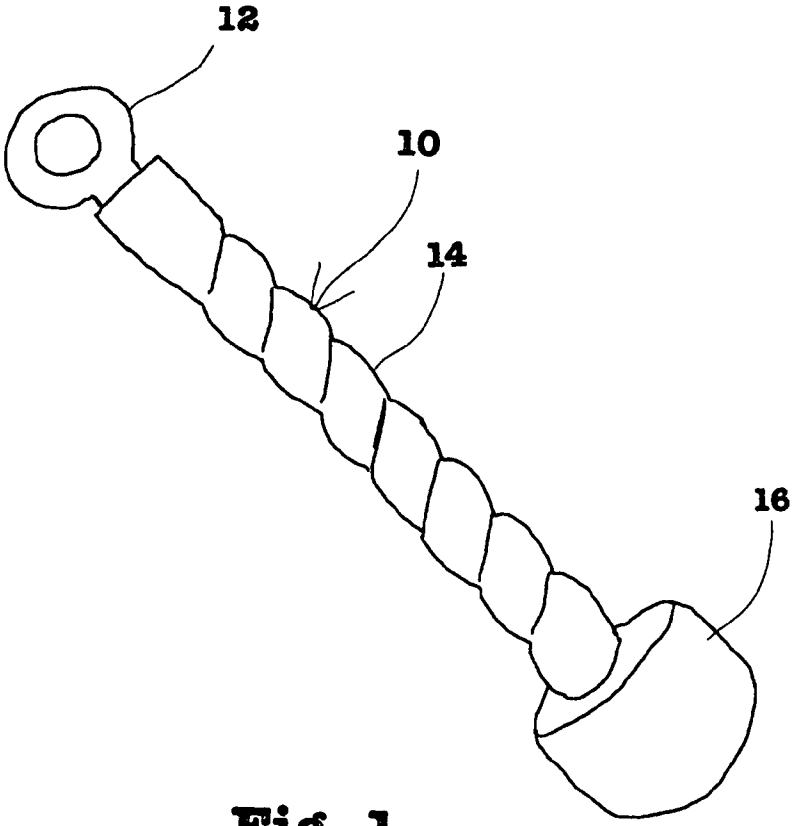
Fig. 1 (prior art)
FIG. 1 is a perspective view of a prior art triceps single rope extension device for attachment to a cable resistance exercise machine.

FIG. 1 refers to a prior art rope extension device 10 which includes a rope portion 14, rubber handrest 16 and connection loop 12.

Figure 2:
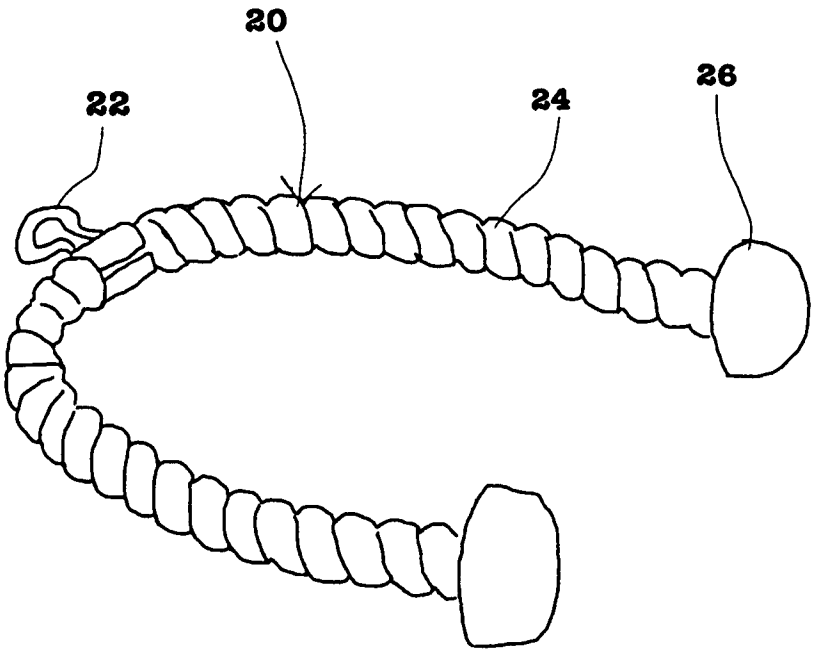
Fig. 2 (prior art)
FIG. 2 is a perspective view of a prior art triceps double rope extension device for attachment to a cable resistance exercise machine.

FIG. 2 refers to a prior art double rope connector which includes a connector 20 which includes a rope portion 24 with a connection loop 22 provided in a mid-portion thereof together with two (2) rubber handrests 26. The device in FIG. 2 is utilized when the user wishes to exercise both arms at the same time.

Figure 3:
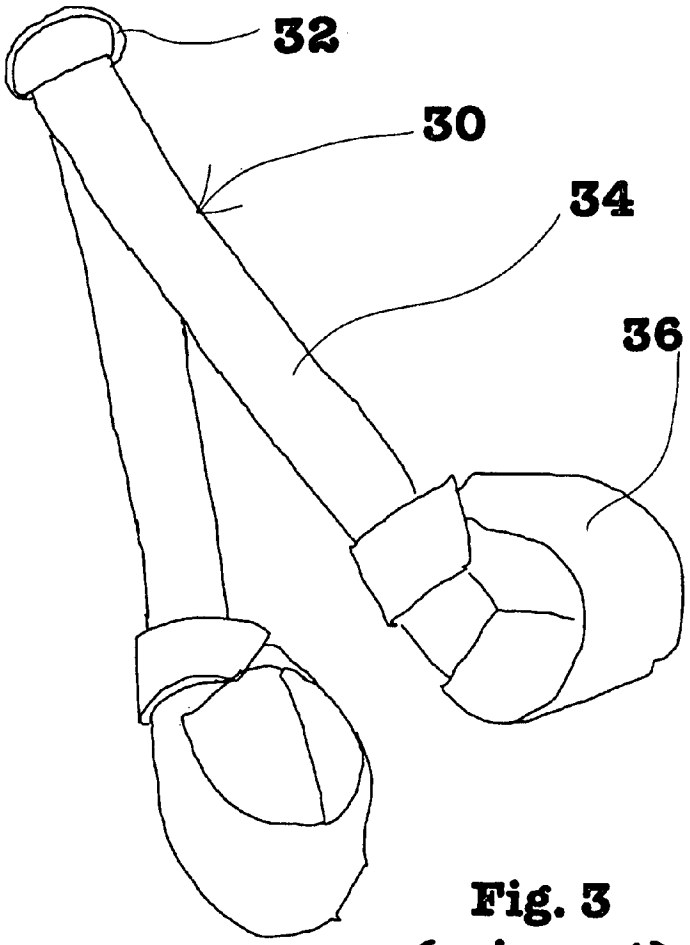
Fig. 3 (prior art)
FIG. 3 is a perspective view of a prior art nylon strap triceps cable extension device for attachment to a cable resistance exercise machine.

FIG. 3 is a prior art strap extension 30 which includes a nylon strap 34, a connection loop 32 and two handle loops 36.

Figure 4C:
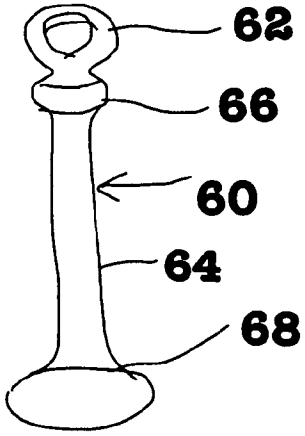
FIGS. 4*a*, 4*b* and 4*c* are perspective views of prior art steel handles for a triceps machine for attachment to a cable resistance exercise machine.
Figure 4B:
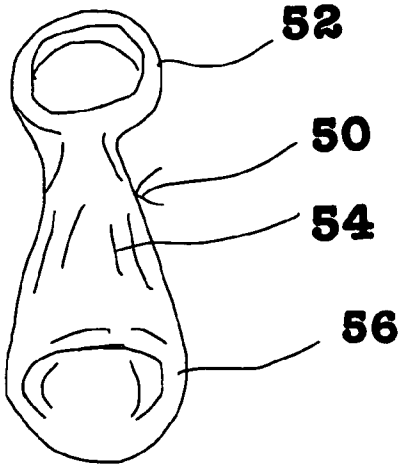
Figure 4A:
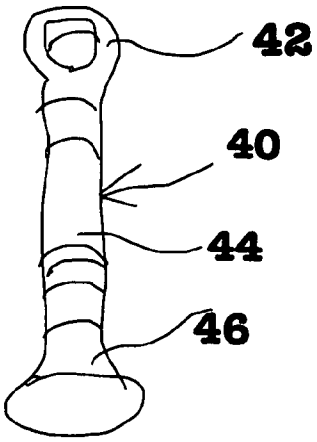
Fig. 4a (prior art)

FIG. 4*a* shows a prior art chrome or stainless steel handle 40 which includes a body portion 44, a handresting portion 46 and a connection loop 42.

FIG. 4*b* shows a prior art chrome or stainless steel gripping handle 50 which includes a body portion 54 which tapers into a large end 56 for gripping and includes a connection loop 52.

FIG. 4*c* shows a prior art chrome or stainless steel gripping handle 60 which includes a body portion 64, an large flange 66, an large handrest 68 and a connection loop 62.

Figure 5:
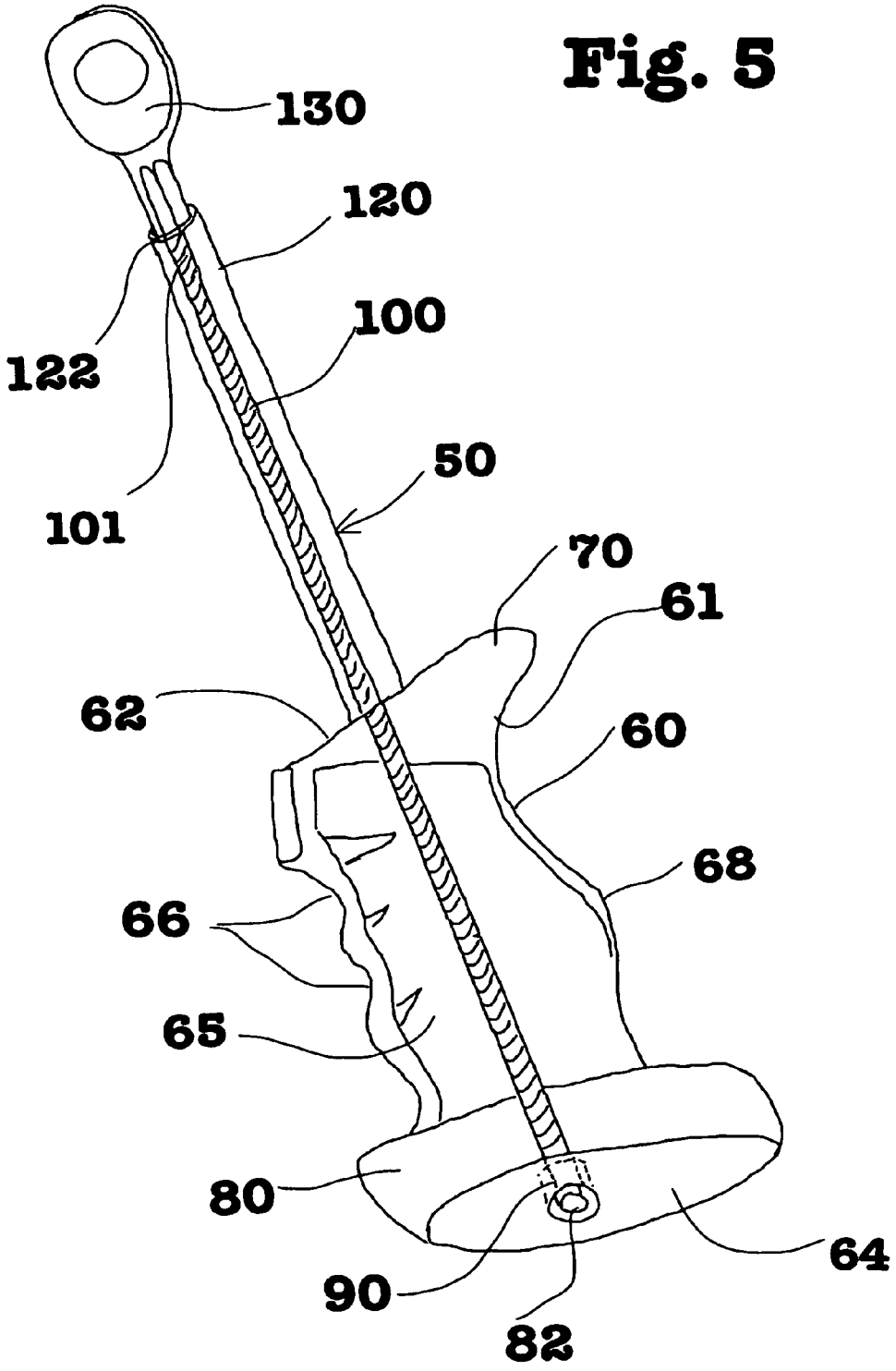
FIG. 5 is a perspective view of a triceps cable extension device according to the present invention for attachment to a cable resistance exercise machine showing the interior location of a wire cable.

Referring to FIG. 5, the basic components of the present invention are shown. A triceps cable extension device 50 is provided for attachment to a cable resistance exercise machine (see FIGS. 9*a* and 9*b*).

A gripping handle 60 which is generally cylindrical has a handle base portion 80 to allow the handle to stand upright on a horizontal surface. The gripping handle 60 also has a handle body portion 65 which has four recesses 66 along a first side thereof configured to receive the fingers of a user. The gripping handle 60 has an extending heel portion 68 on a second side thereof which is configured to be received by the palm of the hand of a user. Gripping handle 60 has a thumb groove 61 on the second side which is configured to receive the thumb of a user. The gripping handle 60 also has a handle top portion 62 which includes a hand protection projection 70 which extends at an angle B upwardly from the thumb groove 61. The handle protection projection 70 has an open semi-circular cross-section projection channel 72 therein which is sized to receive a covered cable. The gripping handle 60 further has a vertical bore 84 therein which extends from the handle base flange portion 80 through the body portion 65 and a cup ending into said projection channel 72.

A length of cable 100 extends through gripping handle 60 and the gripping handle bore 84 with a portion thereof which extends upwardly from the handle top portion 62.

A cable securing means 90 is positioned in a cylindrical recess 82 provided in an underside of the base flange portion 80. The cable securing means 90 is attached to a first end 102 of the cable 100 for preventing the first end 102 of the cable 100 from being pulled upwardly through the handle 60.

Figure 6:
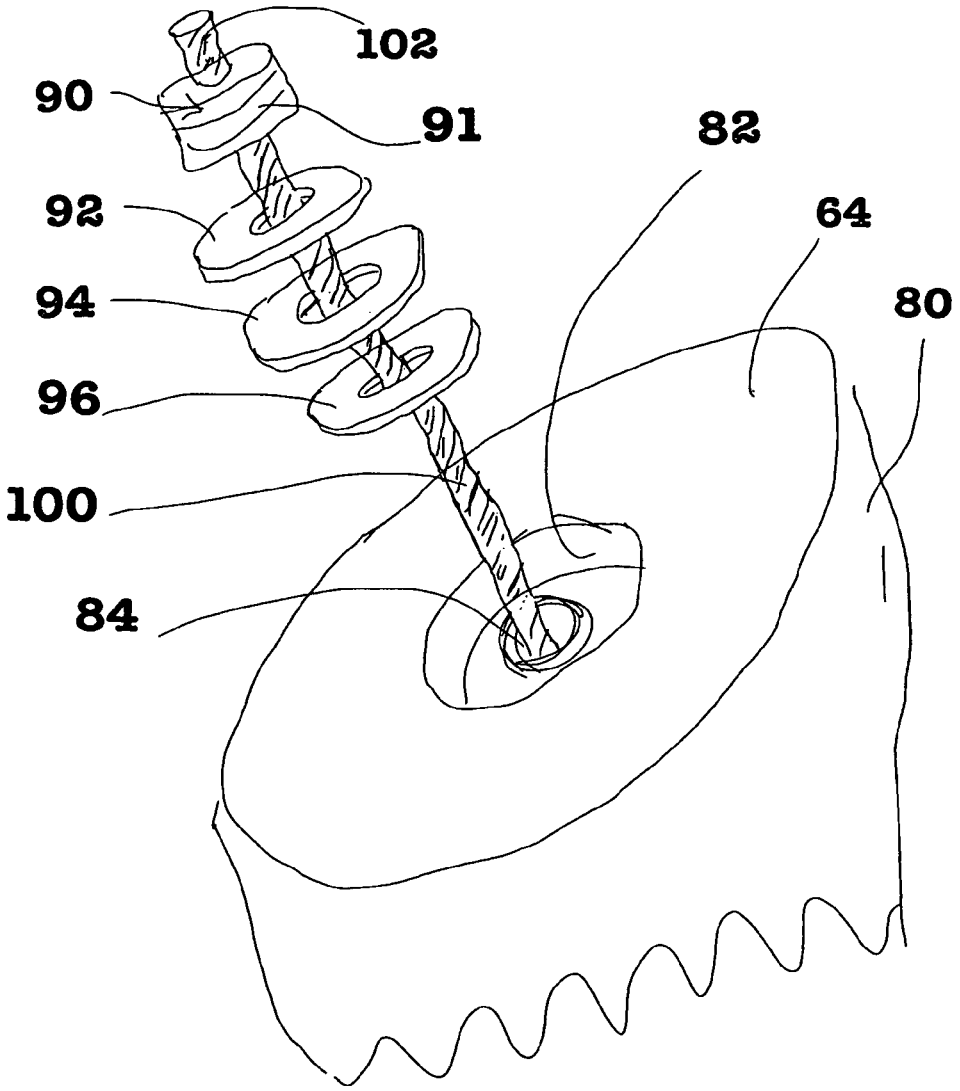
FIG. 6 is a perspective view of the bottom of a gripping handle of the triceps cable extension device of the present invention showing the cable securing means.

The cable securing means 90 which is preferred is shown in FIG. 6. Here a cable crimp nut 91 is crimped onto a first end 102 of cable 100. Two (2) metal washers 92 and 96 and a third washer 94 positioned there between is preferably formed of rubber or nylon. All of these components namely nut 91 and washers 92, 94 and 96 are housed within the recess 82 in the bottom 62 of the base flange portion 80 of the gripping handle 60. It has been found that when the handle 60 and base portion 80 are formed of rubber, which is presently preferred, that when excessive force is placed upon the cable 100 the nut 91 and washer 92 had a tendency to pull upwardly through the bore 84. The introduction of the rubber washer (or nylon) 94 allows the washer 94 to be compressed vertically and thus expand radially when a force is applied to the cable. The radially extension of the washer 94 together with the cushion which the rubber (or nylon) provides prevents the cable securing means 90 from being pulled through the bore 84.

Referring again to FIG. 5, a connection loop 130 is attached to a second end 101 of the cable 100 so as to allow a snap on connection to a cable resistance exercise machine.

A tubing cable cover 120 is provided to cover exposed portions of the cable 100 between the top 62 of the gripping handle 60 and the connection loop 130. This tubing cable cover 120 provides protection against any abrasion wound which might occur if the wire cable were directly exposed. The cable cover is preferably formed from latex and is preferably fabricated in a bright color such as fluorescent yellow, green, pink or orange so as to make the extension device easy to see and give the device a pleasant esthetic look.

Figure 9B:
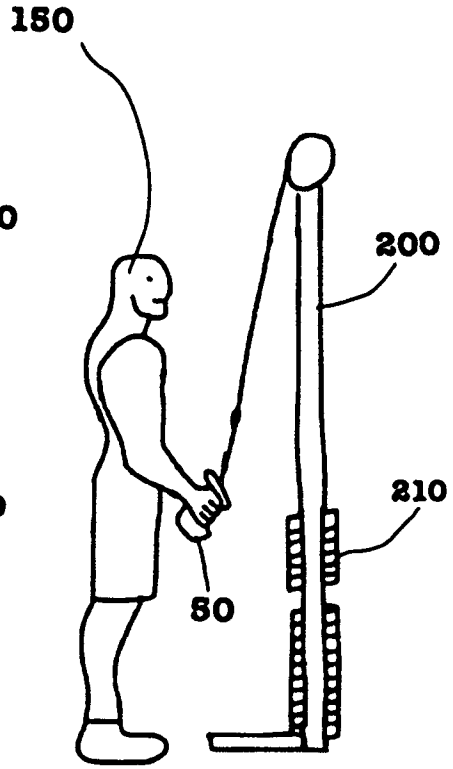
FIG. 9*b* is a side view of the triceps cable extension device of the present invention as attached to a cable resistance exercise machine showing a user in a second position in the triceps exercise with the elbow extended and the device pulled downwardly.
Figure 9A:
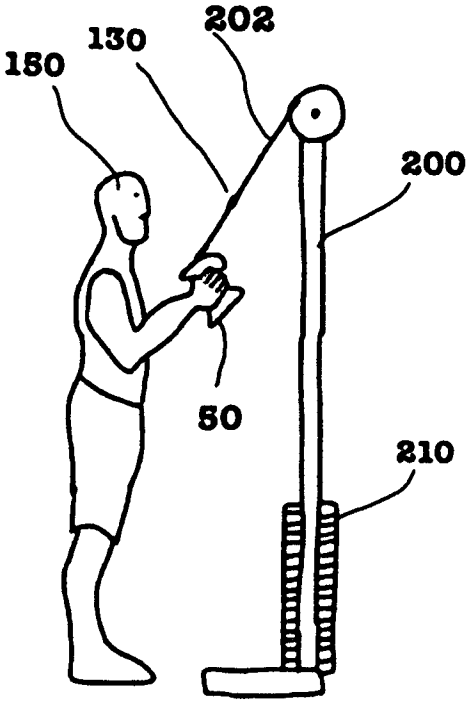
FIG. 9*a* is a side view of a triceps cable extension device according to the present invention as attached to a cable resistance exercise machine showing a user in the beginning position for a triceps exercise with the elbow fully bent.
Figure 10:
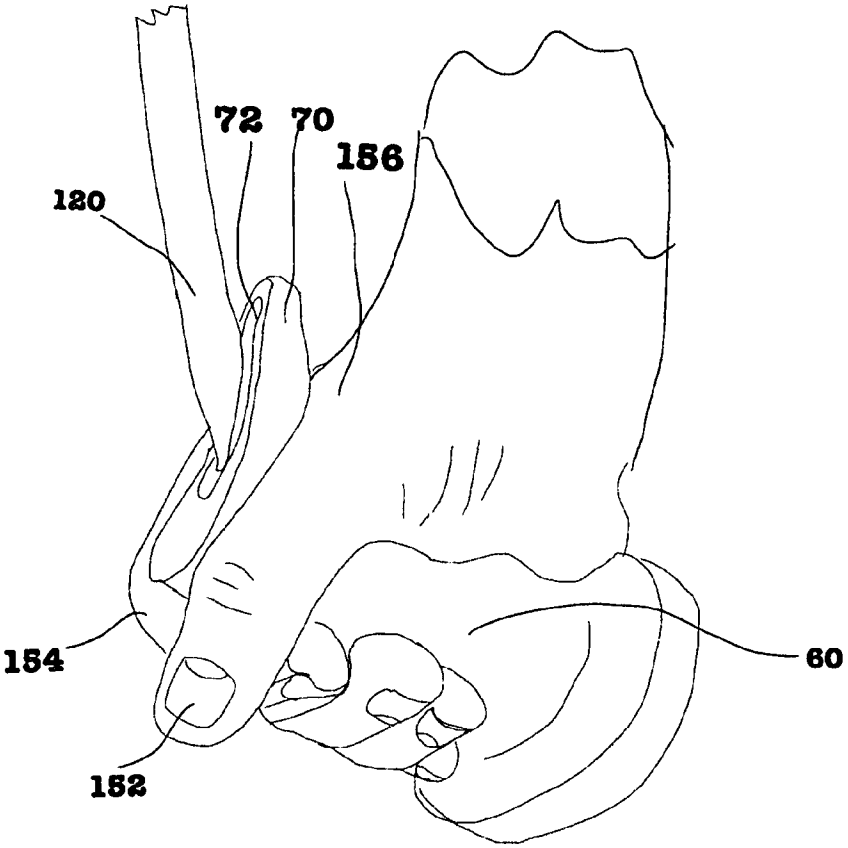
FIG. 10 is a perspective view showing the gripping handle of the present invention as gripped by a user in the second lower position of a triceps exercise showing the tubing cable cover in a projection channel.

Preferably the bore 84 which extends from the handle top portion 62 causes weight to be directed primarily to a user's fingers when pulling downwardly from the position shown in FIG. 9*a* to the position shown in FIG. 9*b*. This is accomplished by means of the projection 70 and the channel 72 therein which has the shape of a pouring spout, and reduces the torque and pressure which would otherwise (if the channel 72 were not there) be directed to the skin 156 between a user's thumb 152 and index finger 154 when pushing downwardly from below a user's waist because said cable 100 is received in said channel 72 as shown in FIG. 10.

The gripping handle 60 of the present invention is preferably formed of rubber but may be made of plastic.

Figure 7:
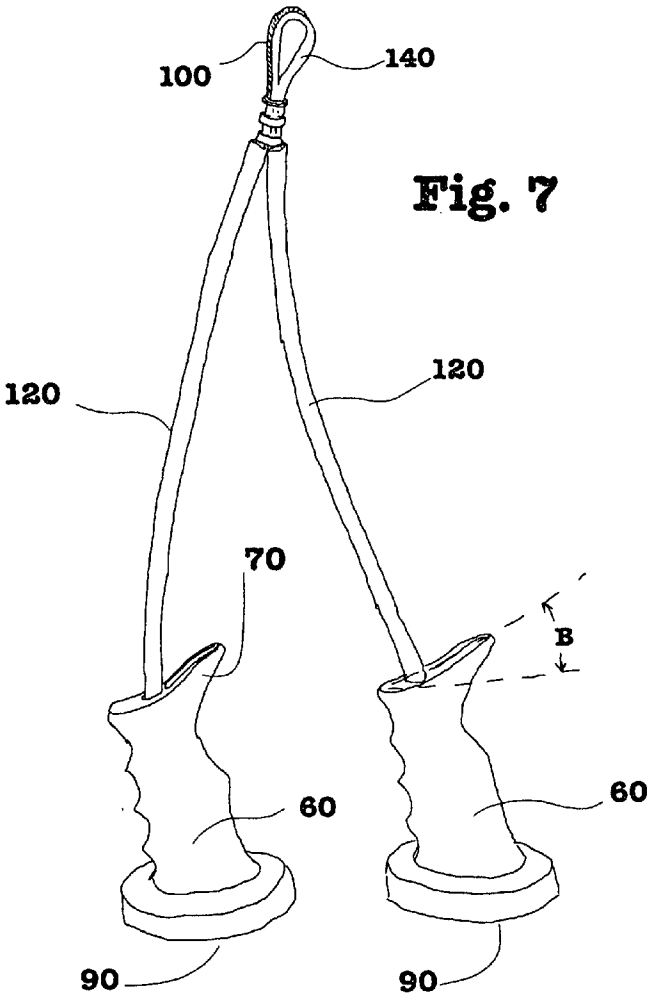
FIG. 7 is a perspective view of a double triceps cable extension device for attachment to a cable resistance exercise machine.

A shown in FIG. 7 the angle B of said protection projection 70 is preferably between 20 degrees and 50 degrees as measured from a horizontal plane when said gripping handles 60 are standing vertically on a horizontal surface. Angle B of the protection projection 70 is preferably approximately 30 degrees.

Figure 8:
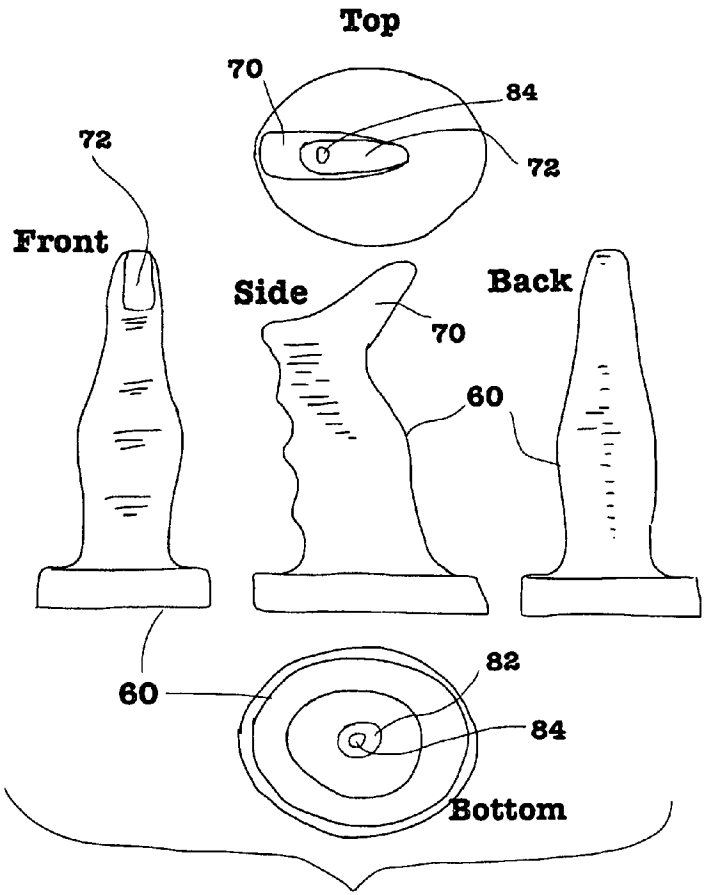
FIG. 8 shows top, front, side, back and bottom views of the preferred gripping handle of the triceps cable extension device of the present invention.

As best shown in the bottom view in FIG. 8, the handle base portion 80 is generally ovoid in shape.

As best shown in FIG. 7 a triceps cable extension device can be provided wherein a pair of gripping handles 60 are attached to a single cable which has a mid-point (100 on FIG. 7) which adjoin a singular cable seal 140 (which serves as the connection loop) allowing a user to exercise with both arms at the same time.

Referring again to FIGS. 9*a* and 9*b* it can be seen that when performing the triceps exercise according to the present invention, a user 150 grips the triceps cable extension device 50 which is attached to a cable 202 of a cable resistance exercise machine 200 at connection loop 130. In this beginning position shown in FIG. 9*a*, the user's elbow is bent and the user's hand is above his waist. Referring to FIG. 9*b* the second position of the triceps exercise is shown. It can be seen that when the user moves his arm downwardly so that his hand is below his waist, the cable 202 is pulled downwardly thus lifting a portion of the weight stack 210 provided on the cable resistance exercise machine 200.

Referring again to FIGS. 9*a* and 10, it is to be understood that angle B of the protection projection 70 and the provision of the projection channel 72 therein greatly affects the amount of torque which is placed on a user's hand. The protection projection 70 serves generally as a guard to prevent the cable 100 where its cover 120 from contacting user's hand. If the present invention were provided without the protection projection 70 and without the projection channel 72 therein increased torque would be placed on the skin at the location 156 as shown in FIG. 10. It is thus the provision of this channel 72 which allows the grip of the handle 60 to be maintained more equally by all of the fingers of the gripping hand when in the lower position shown in FIG. 9*b*.

The protection projection 70 and the channel therein is believed to be an important part of the present invention although the invention would still be an improvement even if just a bore 84 were provided without the projection channel 72.

In terms of the form of the gripping handle, it is noted that it is designed, in part, on the gripping handle of the tactical assault weapon known as an AK-47. The gripping handle allows the user to tightly grip the handle in a manner which is comfortable and effective. The use of such handle on a triceps cable resistance exercise machine greatly improves the experience of the user when performing triceps exercises.

It is to be understood that while certain forms of the present invention have been illustrated and described herein, the present invention is not to be limited to the specific forms or arrangements of parts described and shown.

I claim:

1. A triceps cable extension device for attachment to a cable resistance exercise machine comprising:

a) a gripping handle formed of rubber, said handle being a generally cylindrical member having a handle base flange portion to allow the handle to stand upright on a horizontal surface, a handle body portion, said handle body portion having four recesses along a first side configured to receive the fingers of a user, having a heel portion on a second side which is configured to be received by the palm of the hand a user, a thumb groove on said second side configured to receive the thumb of a user, and a handle top portion including hand protection projection which extends in a generally straight line at an angle B upwardly and radially outwardly from said thumb groove, said angle B being between 20 degrees and 50 degrees as measured from a horizontal plane when said gripping handle is standing vertically on said horizontal surface, said hand protection projection extending radially outwardly to a point located inwardly from an outside edge of said handle base when viewed from a top view and having an open semi-circular cross-section projection channel therein sized to receive a covered cable, said handle having a vertical bore therein extending from the handle base flange portion, through the body portion and extending into said projection channel;

b) a length of cable extending through said gripping handle bore with a portion thereof extending upward away from said handle top portion;

c) a cable securing means, positioned in a cylindrical recess provided in an underside of said base flange portion, said securing means attached to a first end of said cable for preventing said first end of said cable from being pulled upwardly through said handle, said cable securing means comprising a crimp nut crimped onto said first end of said cable with two metal washers and a third washer of rubber or nylon positioned between said two metal washers positioned on said cable between said crimp nut and said underside of said base flange portion in said recess;

d) a connection loop attached to a second end of said cable so as to allow a snap on connection to a cable resistance exercise machine; and e) a tubing cable cover formed of latex, covering exposed portions of said cable between the top of the gripping handle and said connection loop.

2. A triceps cable extension device according to claim 1 wherein said bore extending from said handle top portion causes weight to be directed primarily to a user's fingers when pulling downward from above a user's waist and said angled projection and channel therein reduces the torque and pressure which would otherwise be directed to skin between a user's thumb and index finger when pushing downward from below a user's waist because said cable is received in said channel.

3. A triceps cable extension device according to claim 1 wherein said angle B of said protection projection is approximately 30 degrees as measured from a horizontal plane when said gripping handles are standing vertically on said horizontal surface.

4. A triceps cable extension device according to claim 1 wherein said handle base portion is generally ovoid in shape.

5. A triceps cable extension device according to claim further comprising a second gripping handle, said second gripping handle being identical to said gripping handle and wherein a modified length of cable has a first end which extends through said gripping handle bore with a portion thereof extending upward away from said gripping handle top portion and said modified cable has a second end which extends through said second gripping handle bore with a portion thereof extending upward away from said second gripping handle top portion and wherein a said modified length of cable has a mid-point which extends around said connection loop and wherein said connection loop is attached to said mid-point of said modified length of cable.

* * * * *